US011244594B2

(12) United States Patent
Lo et al.

(10) Patent No.: US 11,244,594 B2
(45) Date of Patent: Feb. 8, 2022

(54) GATE DRIVER CONTROL CIRCUIT, METHOD, AND DISPLAY APPARATUS

(71) Applicants: BEIJING BOE DISPLAY TECHNOLOGY CO., LTD., Beijing (CN); BOE Technology Group Co., Ltd., Beijing (CN)

(72) Inventors: Hsinchung Lo, Beijing (CN); Ming Chen, Beijing (CN); Jieqiong Wang, Beijing (CN)

(73) Assignees: BEIJING BOE DISPLAY TECHNOLOGY CO., LTD., Beijing (CN); BOE Technology Group Co., Ltd., Beijing (CN)

( * ) Notice: Subject to any disclaimer, the term of this patent is extended or adjusted under 35 U.S.C. 154(b) by 444 days.

(21) Appl. No.: 16/468,472

(22) PCT Filed: Sep. 21, 2018

(86) PCT No.: PCT/CN2018/106987
§ 371 (c)(1),
(2) Date: Jun. 11, 2019

(87) PCT Pub. No.: WO2019/242140
PCT Pub. Date: Dec. 26, 2019

(65) Prior Publication Data

US 2021/0358382 A1 Nov. 18, 2021

(30) Foreign Application Priority Data

Jun. 19, 2018 (CN) ..... 201810628334.1

(51) Int. Cl.
*G09G 3/20* (2006.01)
*G09G 3/36* (2006.01)
(Continued)

(52) U.S. Cl.
CPC ..... *G09G 3/2092* (2013.01); *G09G 3/30* (2013.01); *G09G 3/36* (2013.01); *G09G 3/3266* (2013.01);
(Continued)

(58) Field of Classification Search
CPC ..... G09G 3/2092; G09G 3/30; G09G 3/36; G09G 3/3266; G09G 3/3674;
(Continued)

(56) References Cited

U.S. PATENT DOCUMENTS 7,116,321 B2 * 10/2006 Morita ..... G09G 3/20 345/204
7,821,487 B2 * 10/2010 Tanaka ..... G09G 5/001 345/100
(Continued)

FOREIGN PATENT DOCUMENTS

CN 1530908 A 9/2004
CN 1571986 A 1/2005
(Continued)

OTHER PUBLICATIONS

First Office Action in the Chinese Patent Application No. 201810628334.1, dated Dec. 19, 2019; English translation attached.

*Primary Examiner* — Michael J Jansen, II
(74) *Attorney, Agent, or Firm* — Intellectual Valley Law, P.C.

(57) ABSTRACT

The present application discloses a gate driver control circuit including an encoder configured to encode instruction information to obtain a coded instruction and to transmit the coded instruction. The gate driver control circuit further includes a decoder coupled to the encoder and configured to decode the coded instruction to obtain the instruction information. Additionally, the gate driver circuit includes at least one multiplexer coupled to the decoder. Each multiplexer is
(Continued)

configured to receive a first set of multiple timing-control signals and the instruction information, to adjust the first set of multiple timing-control signals to a second set of multiple timing-control signals based on the instruction information, and to output the second set of multiple timing-control signals. The gate driver control circuit further includes at least one gate-array sub-circuit. Each gate-array circuit is configured to output multiple row-scanning signals in response to the second set of multiple timing-control signals.

20 Claims, 15 Drawing Sheets

(51) Int. Cl.
*G09G 3/30* (2006.01)
*G09G 3/3266* (2016.01)

(52) U.S. Cl.
CPC ... *G09G 3/3674* (2013.01); *G09G 2310/0213* (2013.01); *G09G 2310/0267* (2013.01); *G09G 2310/0297* (2013.01); *G09G 2310/08* (2013.01)

(58) Field of Classification Search
CPC ... G09G 2310/0213; G09G 2310/0267; G09G 2310/0297; G09G 2310/08
See application file for complete search history.

(56) References Cited

U.S. PATENT DOCUMENTS 7,936,330 B2 * 5/2011 Park ..... G09G 3/3611 345/99
8,004,487 B2 * 8/2011 Tanaka ..... G09G 3/3688 345/98
8,054,278 B2 * 11/2011 Tanaka ..... G09G 5/001 345/98
8,188,963 B2 * 5/2012 Park ..... G09G 3/3648 345/99
8,390,559 B2 * 3/2013 Moriyama ..... H04N 5/66 345/99
8,416,178 B2 * 4/2013 Tanaka ..... G09G 3/3688 345/100
8,674,923 B2 * 3/2014 Tanaka ..... G09G 5/001 345/98
8,766,900 B2 * 7/2014 Tanaka ..... G09G 3/3688 345/100
9,159,268 B2 * 10/2015 Shin ..... G09G 3/3275
9,704,431 B2 * 7/2017 Cho ..... G09G 3/3225
10,068,532 B2 * 9/2018 Suzuki ..... G09G 3/342
10,325,564 B2 * 6/2019 Park ..... G09G 3/3688
10,497,329 B2 * 12/2019 Lee ..... G09G 3/3614
2003/0076288 A1 4/2003 Fish
2004/0135758 A1 * 7/2004 Morita ..... G09G 3/3688 345/98
2004/0233184 A1 11/2004 Toriumi et al.
2004/0263461 A1 12/2004 Park
2008/0074378 A1 * 3/2008 Chuang ..... G09G 3/3611 345/98
2010/0149083 A1 * 6/2010 Park ..... G09G 3/3611 345/99
2011/0007065 A1 * 1/2011 Tanaka ..... G09G 3/3688 345/213
2012/0050146 A1 * 3/2012 Tanaka ..... G09G 3/20 345/92
2012/0133847 A1 * 5/2012 Moon ..... G09G 3/3611 348/790
2013/0057763 A1 3/2013 Cha et al.
2013/0120353 A1 * 5/2013 Tanaka ..... G09G 3/20 345/214
2013/0222350 A1 * 8/2013 Tanaka ..... G09G 3/20 345/204
2013/0307885 A1 * 11/2013 Shin ..... G09G 3/3266 345/691
2014/0375622 A1 * 12/2014 Nakagawa ..... G09G 3/3674 345/212
2015/0145901 A1 * 5/2015 Lee ..... G09G 3/3614 345/691
2015/0295575 A1 * 10/2015 Lee ..... H03K 17/693 327/416
2017/0206847 A1 * 7/2017 Park ..... G09G 3/3688
2021/0225226 A1 * 7/2021 Chen ..... G09G 3/20
2021/0225291 A1 * 7/2021 Lee ..... G09G 3/3275

FOREIGN PATENT DOCUMENTS

CN 101320298 A 12/2008
CN 101499244 A 8/2009
CN 102982759 A 3/2013
CN 104376818 A 2/2015
CN 104933997 A 9/2015

* cited by examiner

GATE DRIVER CONTROL CIRCUIT, METHOD, AND DISPLAY APPARATUS

CROSS-REFERENCE TO RELATED APPLICATION

This application is a national stage application under 35 U.S.C. § 371 of International Application No. PCT/CN2018/106987, filed Sep. 21, 2018, which claims priority to Chinese Patent Application No. 201810628334.1, filed Jun. 19, 2018, the contents of which are incorporated by reference in the entirety.

TECHNICAL FIELD

The present invention relates to display technology, more particularly, to a display-driving method, and a display apparatus implementing the method.

BACKGROUND

In the related art for driving a display panel to display image, there are two major kinds of driving schemes of using gate-driver control signals to scan through all rows of pixels in the display panel. One is to use Normal Gate Driving signals and another is to use Gate On Array signals. No matter what kind of driving scheme, the functional setting of the gate-driver control signals during the image display is basically fixed. For example, the order of scanning the gate-driver control signals is always fixed either in a top down sequential order or a bottom up sequential order.

SUMMARY

In an aspect, the present disclosure provides a gate driver control circuit. The gate driver control circuit includes an encoder configured to encode instruction information to obtain a coded instruction and to transmit the coded instruction. The gate driver control circuit further includes a decoder coupled to the encoder and configured to decode the coded instruction to obtain the instruction information. Additionally, the gate driver control circuit includes at least one multiplexer coupled to the decoder. Each multiplexer is configured to receive a first set of multiple timing-control signals and the instruction information. Each multiplexer is also configured to adjust the first set of multiple timing-control signals to a second set of multiple timing-control signals based on the instruction information and to output the second set of multiple timing-control signals. Furthermore, the gate driver control circuit includes at least one gate-array sub-circuit. Each gate-array sub-circuit is configured to output multiple row-scanning signals in response to the second set of multiple timing-control signals.

Optionally, each multiplexer is configured to adjust a first timing order of the first set of multiple timing-control signals to a second timing order based on the instruction information to obtain the second set of multiple timing-control signals. The second set of multiple timing-control signals is the first set of multiple timing-control signals in the second timing order.

Optionally, each gate-array sub-circuit is configured, in response to the second set of multiple timing-control signals, to output the multiple row-scanning signals in a timing order corresponding to the second timing order.

Optionally, the encoder is configured to determine instruction information based on data information for an image to be displayed. The instruction information includes the second timing order.

Optionally, the encoder is configured to transmit a clock-setting signal through a first control line to the decoder and to transmit a gate-driver start signal and the coded instruction through a second control line to the decoder. Timing order of the clock-setting signal is associated with timing order of the coded instruction.

Optionally, the encoder is configured to transmit the coded instruction through a first control line to the decoder and to transmit a gate-driver start signal through a second control line to the decoder.

Optionally, the decoder is configured to transfer the gate-driver start signal to the gate-array sub-circuit. The gate-array sub-circuit is further configured to output the row-scanning signals in response to the gate-driver start signal.

Optionally, the instruction information includes multiple sub-instructions information associated respectively with the first set of multiple timing-control signals. The multiplexer includes multiple AND-gate sub-circuits. Each of the multiple AND-gate sub-circuits is configured to receive the first set of multiple timing-control signals and the multiple sub-instructions information, and to output one of the second set of multiple timing-control signals based on logic AND calculations of the first set of multiple timing-control signals and the multiple sub-instructions information.

Optionally, each multiplexer is configured to receive the first set of multiple timing-control signals from the encoder.

Optionally, the gate driver control circuit further includes a timing-signal generator sub-circuit configured to generate the first set of multiple timing-control signals and to transmit the first set of multiple timing-control signals to the at least one multiplexer.

In another aspect, the present disclosure provides a display apparatus containing the gate driver control circuit described herein.

In yet another aspect, the present disclosure provides a method for driving a gate driver control circuit. The method includes encoding instruction information to obtain coded instruction. The method further includes transmitting the coded instruction. Additionally, the method includes decoding the coded instruction to obtain the instruction information. The method further includes receiving a first set of multiple timing-control signals and the instruction information. Furthermore, the method includes adjusting the first set of multiple timing-control signals to a second set of multiple timing-control signals based on the instruction information. Moreover, the method includes generating multiple row-scanning signals in response to the second set of multiple timing-control signals.

Optionally, the step of encoding instruction information includes using an encoder to encode the instruction information to the coded instruction.

Optionally, the step of transmitting the coded instruction and the step of decoding the coded instruction includes using an encoder to transmit the coded instruction to a decoder and using the decoder to decode the coded instruction to obtain the instruction information.

Optionally, the step of adjusting includes using a multiplexer to adjust a first timing order of the first set of multiple timing-control signals to a second timing order based on the instruction information to obtain the second set of multiple timing-control signals. The second set of multiple timing-control signals is the first set of multiple timing-control signal in the second timing order.

Optionally, the step of generating multiple row-scanning signals in response to the second set of multiple timing-control signals includes using a gate-array sub-circuit to output the multiple row-scanning signals in a timing order corresponding to the second timing order.

Optionally, the step of encoding instruction information includes determining the instruction information based on data information for an image to be displayed. The instruction information includes the second timing order.

Optionally, the steps of transmitting the coded instruction and decoding the coded instruction comprise further include transmitting a clock-setting signal through a first control line to the decoder and transmitting a gate-driver start signal and the coded instruction through a second control line to the decoder. Alternatively, the steps of transmitting the coded instruction and decoding the coded instruction comprise further include transmitting the coded instruction through a first control line to the decoder and transmitting a gate-driver start signal through a second control line to the decoder.

Optionally, the steps of transmitting the coded instruction and decoding the coded instruction further include transmitting the gate-driver start signal and the coded instruction through a control line to the decoder.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

In the related image display techniques, the functional setting is basically fixed for using gate driver control signals to drive the display apparatus. For example, a scanning scheme for a gate-driver circuit to use the gate driver control signals as row-scanning signals to scan through the display apparatus is always in a sequential order row-by-row from top to bottom or bottom to up. This results in inflexible control of the row-scanning signals generated by the gate-driver circuit. For some special images, such as Horizontal Stripes, using the fixed scanning scheme takes relatively high power consumption.

Figure 1:
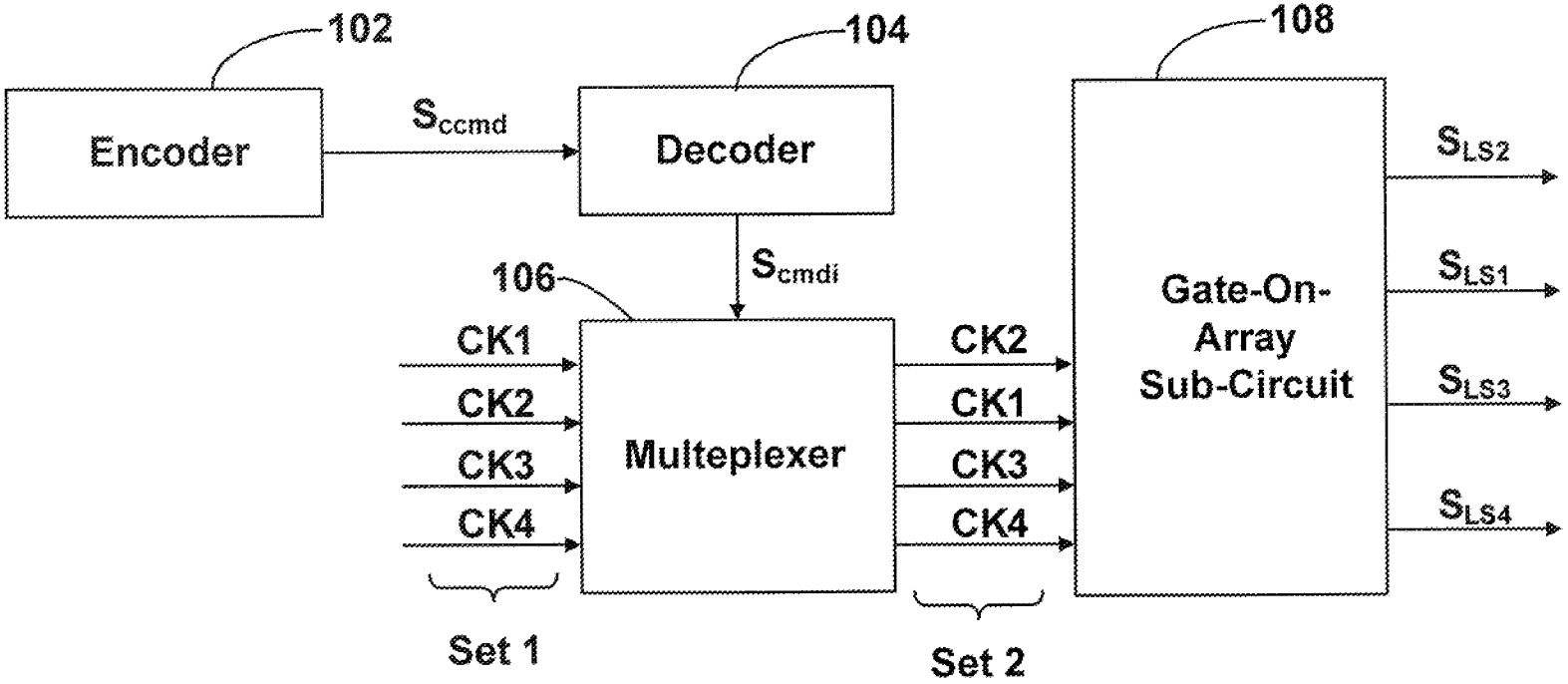
FIG. 1 is a block diagram of a gate driver control circuit according to some embodiments of the present disclosure.

Accordingly, the present disclosure provides, inter alia, a gate driver control circuit for flexibly control row-scanning signals to drive display apparatus, a method for driving the gate driver control circuit and a display apparatus having the same that substantially obviate one or more of the problems due to limitations and disadvantages of the related art. In one aspect, the present disclosure provides a gate driver control circuit. FIG. 1 is a block diagram of a gate driver control circuit according to some embodiments of the present disclosure. Referring to FIG. 1, the gate driver control circuit includes an encoder 102, a decoder 104, at least one multiplexer 106, and at least one gate-on-array sub-circuit 108.

The encoder 102 is configured to encode instruction information to obtain coded instruction $S_{ccmd}$ and to transmit the coded instruction $S_{ccmd}$. The decoder 104 is configured to decode the coded instruction to obtain the instruction information $S_{cmdi}$. The multiplexer 106 is configured to receive a first set of multiple timing-control signals and the coded instruction $S_{cmdi}$. It is also configured to adjust the first set of multiple timing-control signals to a second set of multiple timing-control signals based on the instruction information $S_{cmdi}$ and output the second set of multiple timing-control signals. For example, each of the first set of multiple timing-control signals and the second set of timing-control signals includes four timing-control signals: CK1~CK4. In other examples, each of the first set of multiple timing-control signals and the second set of timing-control signals includes eight or ten or more timing-control signals.

The gate-on-array sub-circuit 108 is configured to output multiple row-scanning signals in response to the corresponding second set of multiple timing-control signals received from the multiplexer 106. For example, FIG. 1 shows four row-scanning signals: $S_{LS1}$~$S_{LS4}$. In other examples, each gate-on-array sub-circuit can output multiple row-scanning signals with different numbers such as 8, 10, or more. In an embodiment, the gate-on-array sub-circuit 108 can output the multiple row-scanning signals to an array of gate-driving circuits (not shown in FIG. 1) to drive corresponding multiple rows of subpixels for image display.

In the embodiment of the gate driver control circuit, the encoder performs encoding operation of the instruction information to obtain coded instructions and performs transmitting the coded instructions to the decoder. The decoder performs decoding operation of the coded instructions to obtain the instruction information and performs sending the instruction information to the multiplexer. The multiplexer receives a first set of multiple timing-control signals and the instruction information and performs an adjusting operation to transform the first set of multiple timing-control signals to a second set of multiple timing-control signals based on the instruction information. The multiplexer also performs an outputting operation to output the second set of multiple timing-control signals to the gate-on-array sub-circuit. The gate-on-array sub-circuit then outputs multiple row-scanning signals in response to the corresponding second set of multiple timing-control signals received from the multiplexer. By proper setting the instruction information, the multiplexer can flexibly adjust the multiple timing-control signals and output the adjusted multiple timing-control signals to the gate-on-array sub-circuit and further drive the gate-on-army sub-circuit to output corresponding row-scanning signals flexibly.

For example, the coded instructions can be defined based on specific requirements so that the coded instructions can carry different instruction information. Further, the multiple row-scanning signals can be controlled based on the specific requirements. For example, the coded instructions can carry instruction for controlling scanning the row-scanning signals in a specific order or performing different number of repeated scans, etc.

In some embodiments, referring to FIG. 1, the multiplexer 106 is configured to adjust a first order of the first set of multiple timing-control signals to a second order to obtain the second set of multiple timing-control signals. For example, the first set of multiple timing-control signals is in the following order: CK1→CK2→CK3→CK4. The multiplexer adjusts the order of the first set of multiple timing-control signals to a new order-CK2→CK1→CK3→CK4. In this case, the second set of multiple timing-control signals is merely the first set of the multiple timing-control signals in a second order. The multiplexer outputs the second set of multiple timing-control signals with the second order to the corresponding gate-on-army sub-circuit 108.

In some embodiments, the gate-on-array sub-circuit 108 is configured to output multiple row-scanning signals in an order corresponding to that of the second set of the multiple timing-control signals received from the multiplexer 106. For example, in response to the order of the multiple timing-control signals adjusted by the multiplexer 106 (for example, CK2→CK1→CK3→CK4), the gate-on-array sub-circuit 108 outputs the multiple row-scanning signals also in the same order: $S_{LS2}$→$S_{LS1}$→$S_{LS3}$→$S_{LS4}$.

In the embodiments, the multiplexer adjusts the order of the received multiple timing-control signals based on the instruction information and outputs the multiple timing-control signals in the adjusted order to the corresponding gate-on-array sub-circuit. The gate-on-array sub-circuit responds to the multiple timing-control signals in the adjusted order and outputs multiple row-scanning signals with a corresponding order. Since the order of the multiple timing-control signals can be changed through the instruction information during the image display, the display apparatus can manage to change the scanning order to achieve power consumption reduction.

In some embodiments, the encoder 102 is also configured to set different instruction information based on data information for images to be displayed. The instruction information can carry information about the adjusted order of the first set of multiple timing-control signals or the second order of the second set of multiple timing-control signals. For example, the encoder may contain a processor or processing sub-circuit to realize the function of setting the instruction information based on image data information.

In the embodiments, before displaying each frame of image, the encoder obtains data information about the frame of image. Once it is determined that displaying the frame of image will consume high power, the instruction information with adjusted order of the first set of multiple timing-control signals can be encoded by the encoder. Thus, after the instruction information reaches the multiplexer through the decoder, the multiplexer is able to perform the adjustment of the order of the first set of the multiple timing-control signals based on the instruction information to obtain a second set of the multiple timing-control signals. The multiplexer then can output the multiple timing-control signals with the adjusted order to the gate-on-array sub-circuit to allow it to adjust corresponding order of multiple row-scanning signals and dynamically change the scanning order of the multiple row-scanning signals during the process of displaying the frame of image, achieving the purpose of reducing power consumption.

In some embodiments, the coded instruction can be used to define other operation functions other than change the scanning order of the row-scanning signals. For example, the coded instruction may contain In-cell touch re-scan line function or Gate-on-array (GOA) pre-charge function for operating the gate-on-array sub-circuit. In the example, the In-cell touch re-scan line function is referred to a function of an In-cell touch integrated circuit that is to repeat scanning last few rows of data before ending the image display and entering a touch-control mode. The gate driver control circuit of the present disclosure is able to provide a dynamic adjustment of the number of rows being repeatedly scanned by defining the coded instruction generated by the encoder.

In another example, the pre-charge function is referred a function of the GOA circuit to start up several rows of pixel driving circuits in a display panel before displaying the corresponding image data. The gate driver control circuit of the present disclosure is able to dynamically adjust the number of rows of pixel-driving circuits that need pre-charging before displaying image by defining the coded instruction generated by the encoder. The decoder, after receives the coded instruction from the encoder, performs a decoding operation to the coded instruction to obtain a decoded instruction information and send the decoded instruction information to the multiplexer. The multiplexer is then configured to move ahead the timing of the first set of multiple timing-control signals corresponding to the number of rows based on the decoded instruction information to obtain the second set of multiple timing-control signals. The second set of multiple timing-control signals is outputted to the gate-on-array sub-circuit. The gate-on-array sub-circuit then outputs multiple row-scanning signals to start the corresponding number of rows in response to the second set of multiple timing-control signals. Therefore, the gate driver control circuit of the present disclosure achieves the pre-charge function of the GOA.

In some embodiments, the encoder 102 is also configured to output a gate start-up voltage (STV) signal to the decoder 104. Thus, the decoder 104 can transfer the gate-driver start-up voltage (STV) signal to the gate-on-array sub-circuit so that the row-scanning signals can be outputted by the gate-on-array sub-circuit. Based on the gate-driver start-up voltage signal, each frame of image can be recognized by the GOA circuit.

Figure 2A:
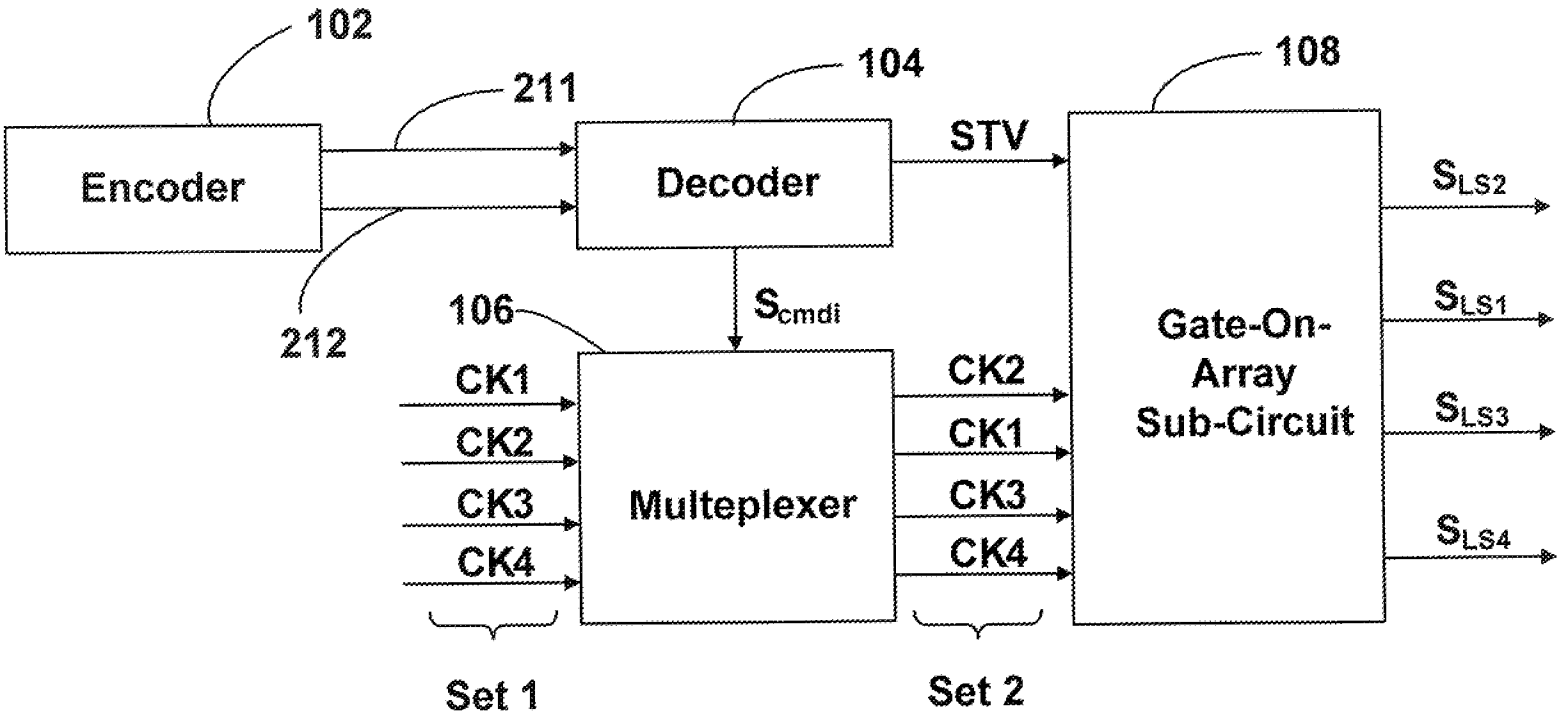
FIG. 2A is a block diagram of another gate driver control circuit according to some embodiments of the present disclosure.

FIG. 2A is a block diagram of another gate driver control circuit according to some embodiments of the present disclosure. Referring to FIG. 2A, in some embodiments of the gate driver control circuit, the encoder 102 can be configured to send clock setting signals via a first control line 211 to the decoder 104. Additionally, the encoder 102 is configured to send a gate-driver start-up voltage signal and coded instruction via a second control line 212 to the decoder 104. The timing of the clock setting signal is corresponding to the timing of coded instruction. In the embodiment two control lines are used to respectively transmit the clock setting signal and coded instruction to the decoder. The decoder can receive these signals easily by adopting a signal receiver circuit that is simple and easy to be manufactured and implemented.

In some embodiments, referring to FIG. 2A, the decoder 104 is configured to transmit the gate-driver start-up voltage (STV) signal to the gate-on-army sub-circuit 108. In some embodiments, the gate-on-array sub-circuit 108 is configured to start outputting row-scanning signals $S_{LS2}$~$S_{LS4}$ in response to the receipt of STV signal. In the embodiment, by transferring the STV signal via the decoder to the gate-on-array sub-circuit to allow the latter to start outputting row-scanning signals, the display panel starts display one frame of image.

Figure 2B:
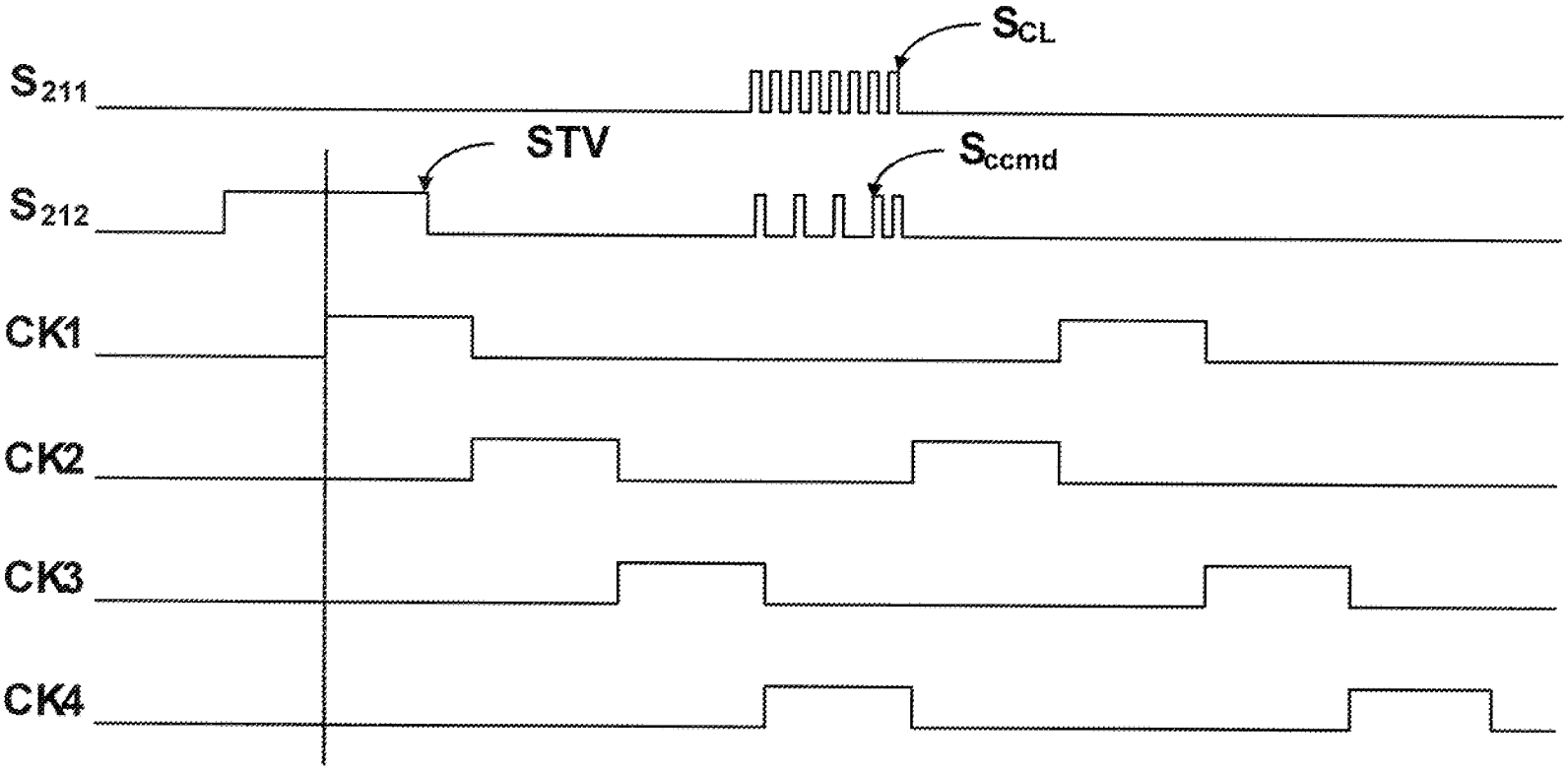
FIG. 2B is a schematic diagram of some timing signals and control signals for operating the gate driver control circuit of FIG. 2A according to some embodiments of the present disclosure.

FIG. 2B is a schematic diagram of some timing signals and control signals for operating the gate driver control circuit of FIG. 2A according to some embodiments of the present disclosure. For example, FIG. 2B shows a first signal $S_{211}$ being transmitted via the first control line 211, a second signal $S_{212}$ being transmitted via the second control line 212, and the timing-control signals CK1~CK4.

The first signal $S_{211}$ includes a clock setting signal $S_{CL}$. The second signal $S_{212}$ includes the STV signal and the coded instruction $S_{ccmd}$. The timing of the clock setting signal $S_{CL}$ is corresponding to the timing of the coded instruction $S_{ccmd}$. Once the coded instruction $S_{ccmd}$ occurs (in this timing diagram), the adjustment of the order of subsequent timing-control signals CK1~CK4 can be performed. For example, FIG. 2B shows that after the coded instruction $S_{ccmd}$ is received, the order of the timing-control signals CK1~CK4 is given as CK2→CK1→CK3→CK4.

In some embodiments, the location of the coded instruction $S_{ccmd}$ on the timing diagram can be alternatively determined according to applications. For example, the coded instruction $S_{ccmd}$ is set to be after the STV signal, as shown in FIG. 2B. Alternatively, the coded instruction $S_{ccmd}$ is set to be before the STV signal.

Figure 2C:
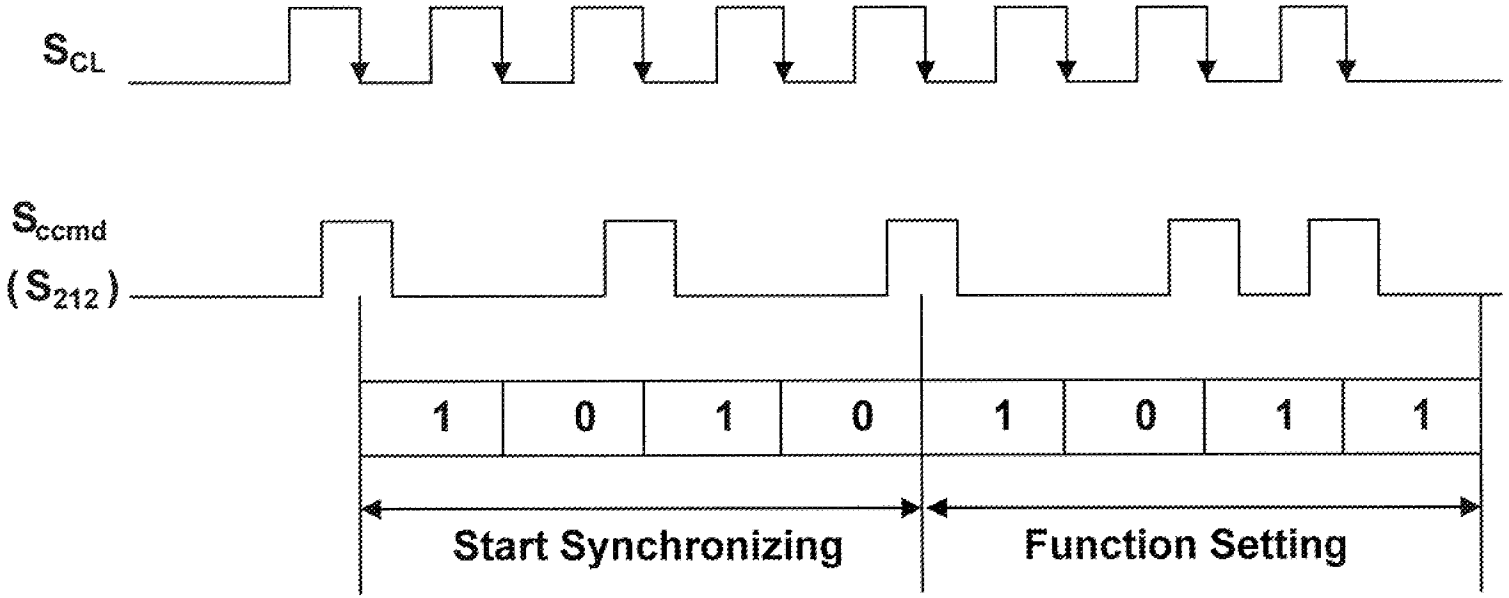
FIG. 2C is a timing diagram of clock setting signals and coded instructions for operating the gate driver control circuit of FIG. 2A according to some embodiments of the present disclosure.

FIG. 2C is a timing diagram of clock setting signals and coded instructions for operating the gate driver control circuit of FIG. 2A according to some embodiments of the present disclosure. Referring to FIG. 2C, the clock setting signal $S_{CL}$ and the coded instruction $S_{ccmd}$ in the second signal $S_{212}$ are shown. Each code of coded instruction $S_{ccmd}$ corresponds to a falling edge of each clock signal associated with the clock setting signal SC. In other words, the decoder reads the coded instruction $S_{ccmd}$ by using the falling edge of the clock setting signal and obtains the decoded instruction information based on coded instruction.

In some embodiments, the coded instruction $S_{ccmd}$ includes a portion with start synchronizing codes and another portion with function setting codes. The function setting codes carry the instruction information. For example, in the coded instruction shown in FIG. 2C, "1010" belong to the start synchronizing codes and "1011" belong to function setting codes. In the embodiment, by setting the start synchronizing codes, numbers of false positive control are reduced and the function setting can be started after synchronization is successfully started. Of course, the digital codes for the start synchronizing codes can be in other numeral combinations rather than "1010". The digital codes for the function setting codes also can be in other numeral combinations rather than "1011", The function setting codes also are not limited to 4 bit shown in FIG. 2C but can be in any bits of codes.

Figure 3A:
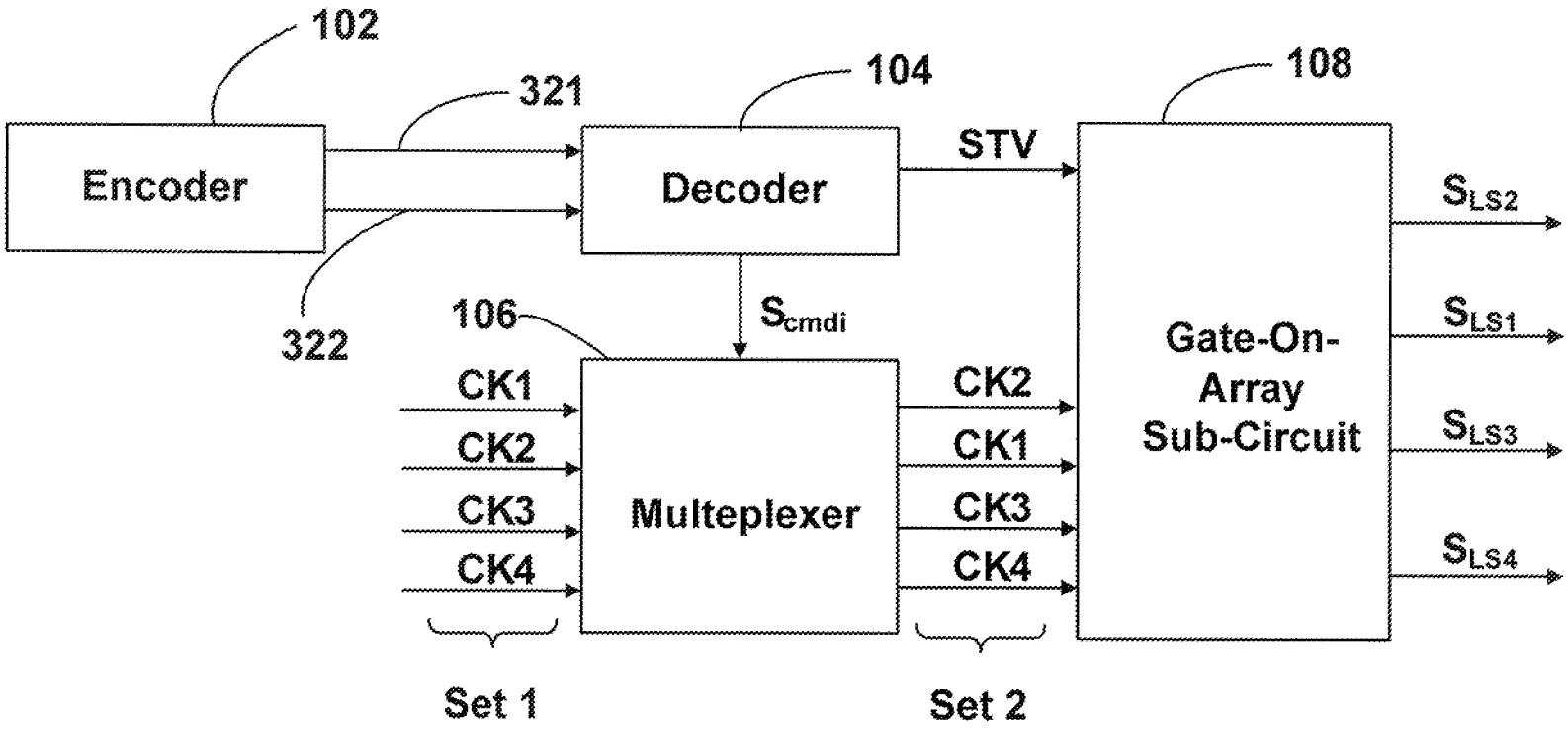
FIG. 3A is a block diagram of yet another gate driver control circuit according to some embodiments of the present disclosure.

FIG. 3A is a block diagram of yet another gate driver control circuit according to some embodiments of the present disclosure. Referring to FIG. 3A, the encoder 102 is configured to send coded instruction via a first control line 321 to the decoder 104 and send a gate-driver start-up voltage signal via a second control line 322 to the decoder 104. In the embodiment, two control lines are used to respectively transmit the coded instruction and the gate-driving start-up signal to the decoder. The decoder can obtain the gate-driver start-up voltage signal as well as obtain the instruction information by decoding the coded instruction. Additionally, similar to FIG. 2A, the encoder 102 in the gate driver control circuit of FIG. 3A also can transmit the gate-driver start-up voltage (STV) signal to the gate-on-array sub-circuit 108.

Figure 3B:
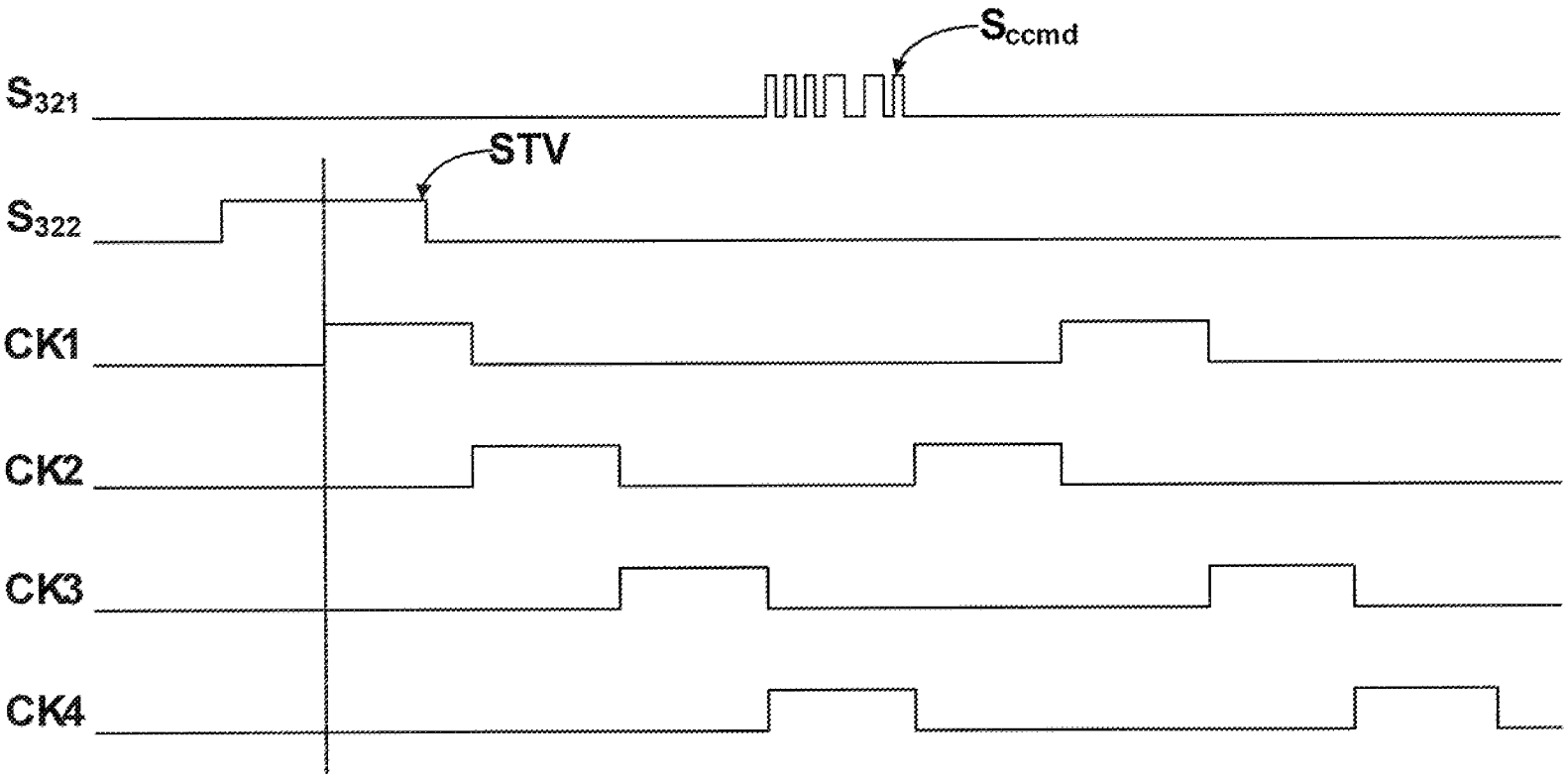
FIG. 3B is a schematic diagram of some timing signals and control signals for operating the gate driver control circuit of FIG. 3A according to some embodiments of the present disclosure.

FIG. 3B is a schematic diagram of some timing signals and control signals for operating the gate driver control circuit of FIG. 3A according to some embodiments of the present disclosure. Referring to FIG. 3B, a first control line 321 is used to transmit a first signal $S_{321}$. A second control line 322 is used to transmit a second signal Sm and several timing-control signals CK1~CK4. The first signal $S_{321}$ includes coded instructions $S_{ccmd}$. The second signal $S_{322}$ includes STV signal. For example, FIG. 3B shows that after the coded instructions $S_{ccmd}$ are provided in the timing diagram, the subsequent timing order for the timing-control signals CK1~CK4 is CK2→CK1→CK3→CK4.

In some embodiments, the location of the coded instructions $S_{ccmd}$ in the timing diagram can be determined based needs of applications. For example, the coded instructions $S_{ccmd}$ can be placed after the STV signal as shown in FIG. 3B or before the STV signal.

Figure 3C:
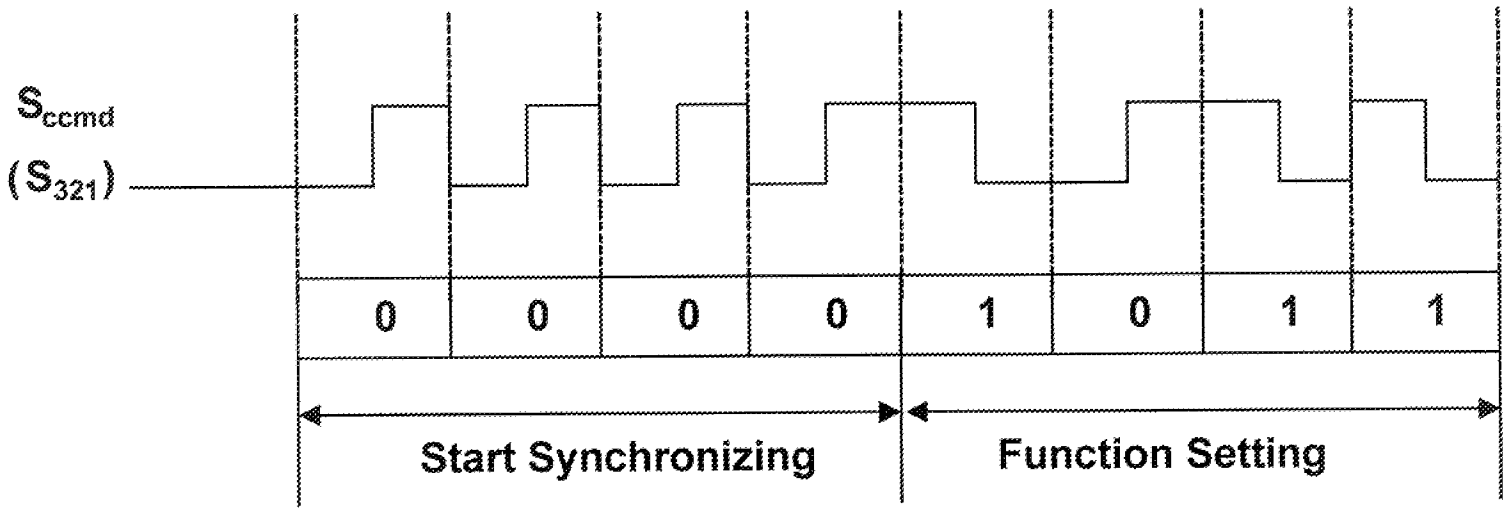
FIG. 3C is a timing diagram of coded instructions for operating the gate driver control circuit of FIG. 3A according to some embodiments of the present disclosure.

FIG. 3C is a timing diagram of coded instructions for operating the gate driver control circuit of FIG. 3A according to some embodiments of the present disclosure. As seen, the coded instruction $S_{ccmd}$ is carried in the second signal $S_{322}$. In some embodiments, the coded instruction $S_{ccmd}$ includes a portion with start synchronizing codes and another portion with function setting codes. The function setting codes carry the instruction information. For example, in the coded instruction shown in FIG. 3C, "0000" belong to the start synchronizing codes and "1011" belong to function setting codes. In the embodiment, by setting the start synchronizing codes, numbers of false positive control are reduced and the function setting can be started after synchronization is successfully started.

In some embodiments, as shown in FIG. 3C, the coded instruction $S_{ccmd}$ can be encoded using Manchester II encoding scheme. Of course, other encoding schemes can be adopted. Note, the codes "0000" are preamble codes of Manchester II. Of course, the digital codes for the start synchronizing codes can be in other numeral combinations rather than "0000". For example, "1111" can be used.

Sequential 0 or 1 in the coding forms a clock-like waveform, which can induce a clock signal generated in synchronized manner at a receiver of the signal. The length of the codes also can be changed to 8 bits, such as "00000000", or more. The digital codes for the function setting codes also can be in other numeral combinations rather than "1011".

Figure 4A:
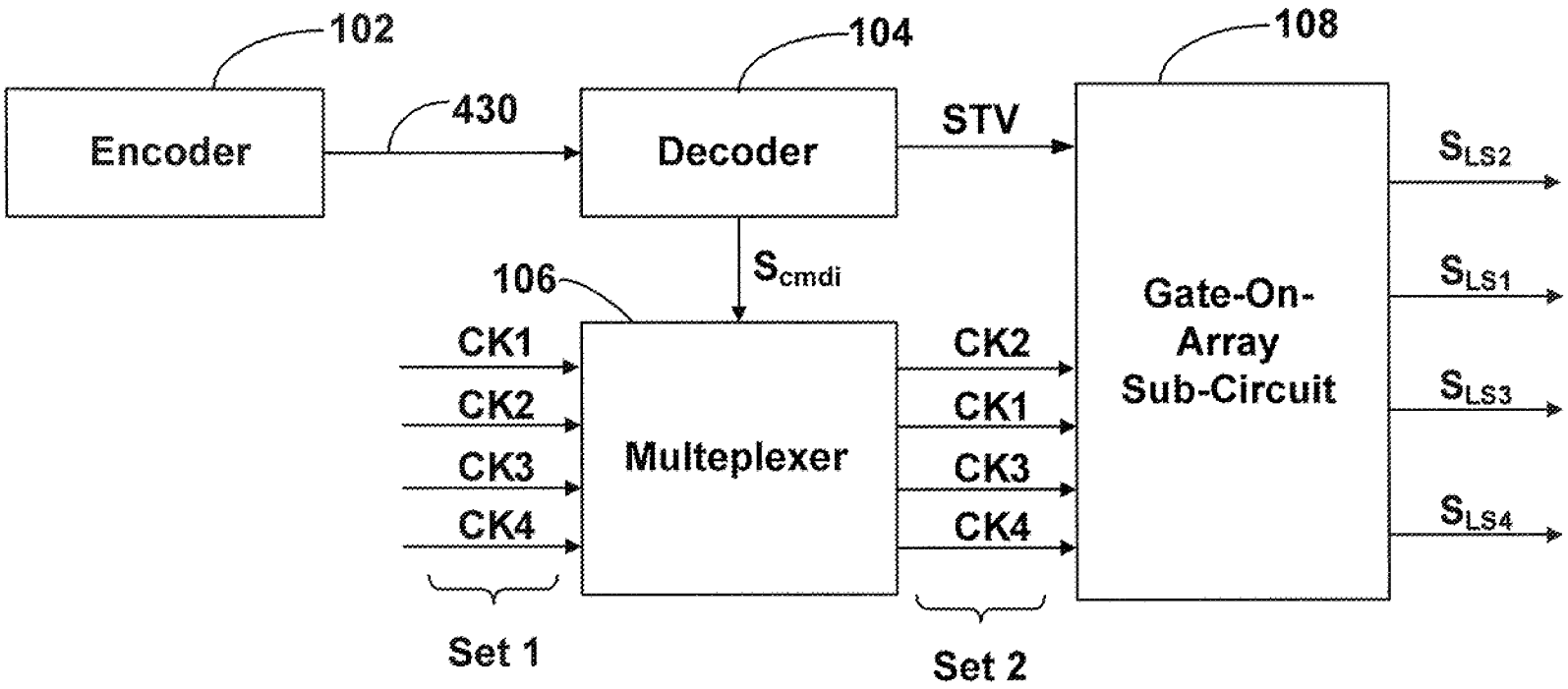
FIG. 4A is a block diagram of still another gate driver control circuit according to some embodiments of the present disclosure.

FIG. 4A is a block diagram of still another gate driver control circuit according to some embodiments of the present disclosure. Referring to FIG. 4A, the encoder 102 is configured to transmit gate-driver start-up voltage signal and the coded instruction via a control line 430. Here, one control line is used to send both the gate-driver start-up voltage signal and the coded instruction, reducing cost and beneficial for making the encoder and decoder compatible to each other. Similar to FIG. 2A, the encoder 102 also sends the gate-driver start-up voltage signal to the gate-on-array sub-circuit 108.

Figure 4B:
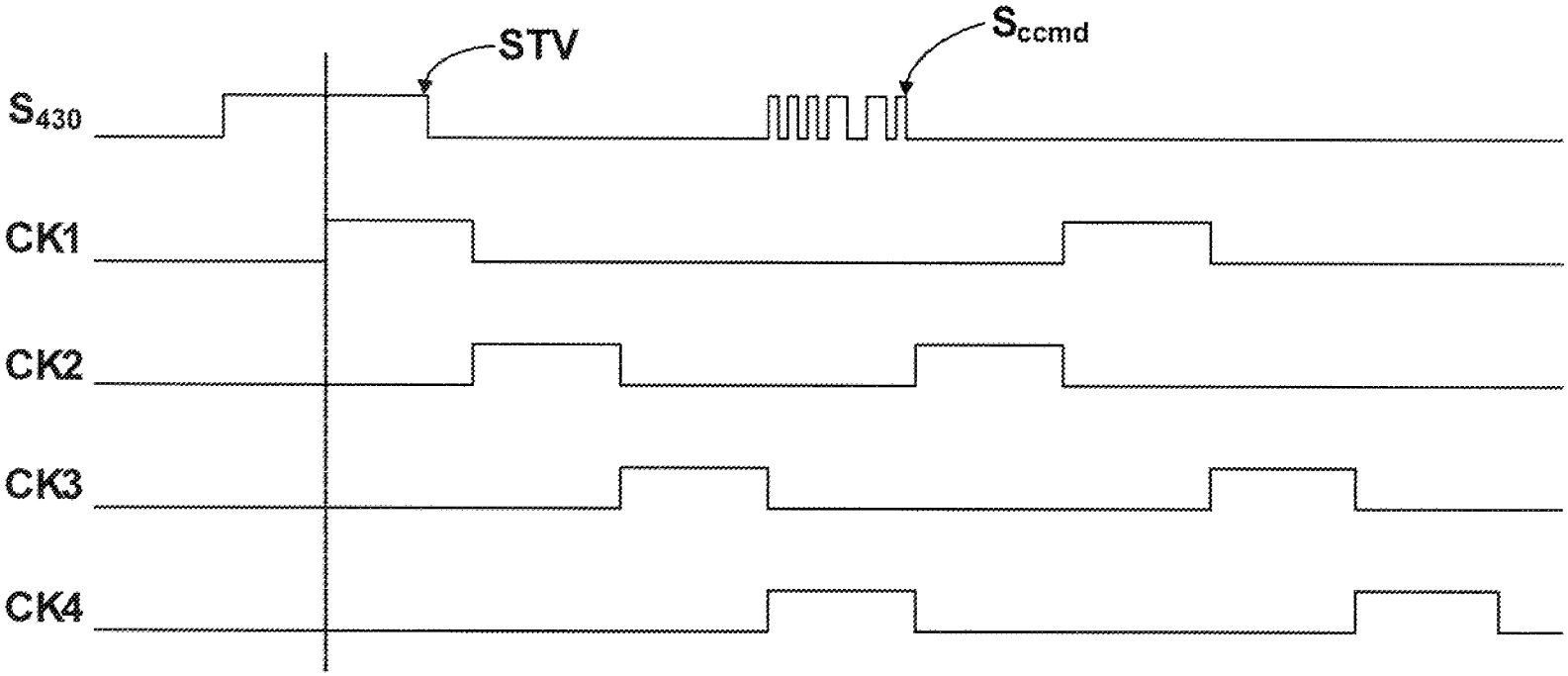
FIG. 4B is a schematic diagram of some timing signals and control signals for operating the gate driver control circuit of FIG. 4A according to some embodiments of the present disclosure.

FIG. 4B is a schematic diagram of some timing signals and control signals for operating the gate driver control circuit of FIG. 4A according to some embodiments of the present disclosure. Referring to FIG. 4B, a control line 430 is used to transmit a signal $S_{430}$ as well as the timing-control signals CK1~CK4. The signal $S_{430}$ includes the gate-driver start-up voltage (STV) signal and carries the coded instruction $S_{ccmd}$. Here an embedded wire method is used to include the control signals into the STV signal. For example, once the coded instruction $S_{ccmd}$ is triggered, the timing order of subsequent timing-control signals CK1~CK4 is given as: CK2→CK1→CK3→CK4.

Figure 4C:
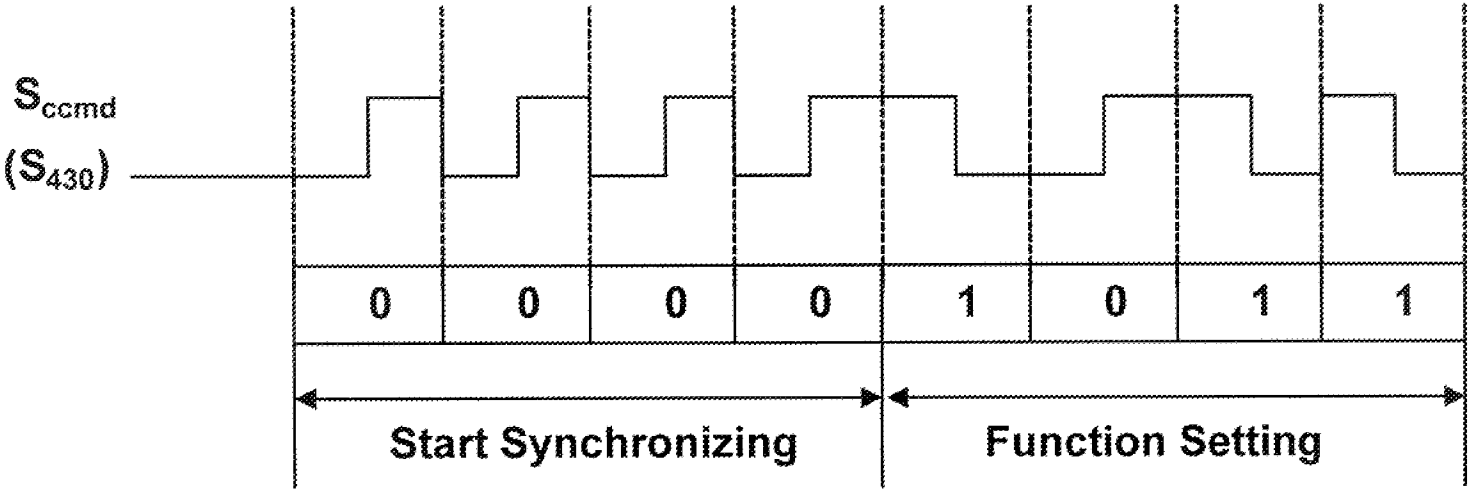
FIG. 4C is a timing diagram of coded instructions for operating the gate driver control circuit of FIG. 4A according to some embodiments of the present disclosure.

In some embodiments, as shown in FIG. 4C, the coded instruction $S_{ccmd}$ can be encoded using Manchester II encoding scheme, similarly in FIG. 3C.

Figure 5:
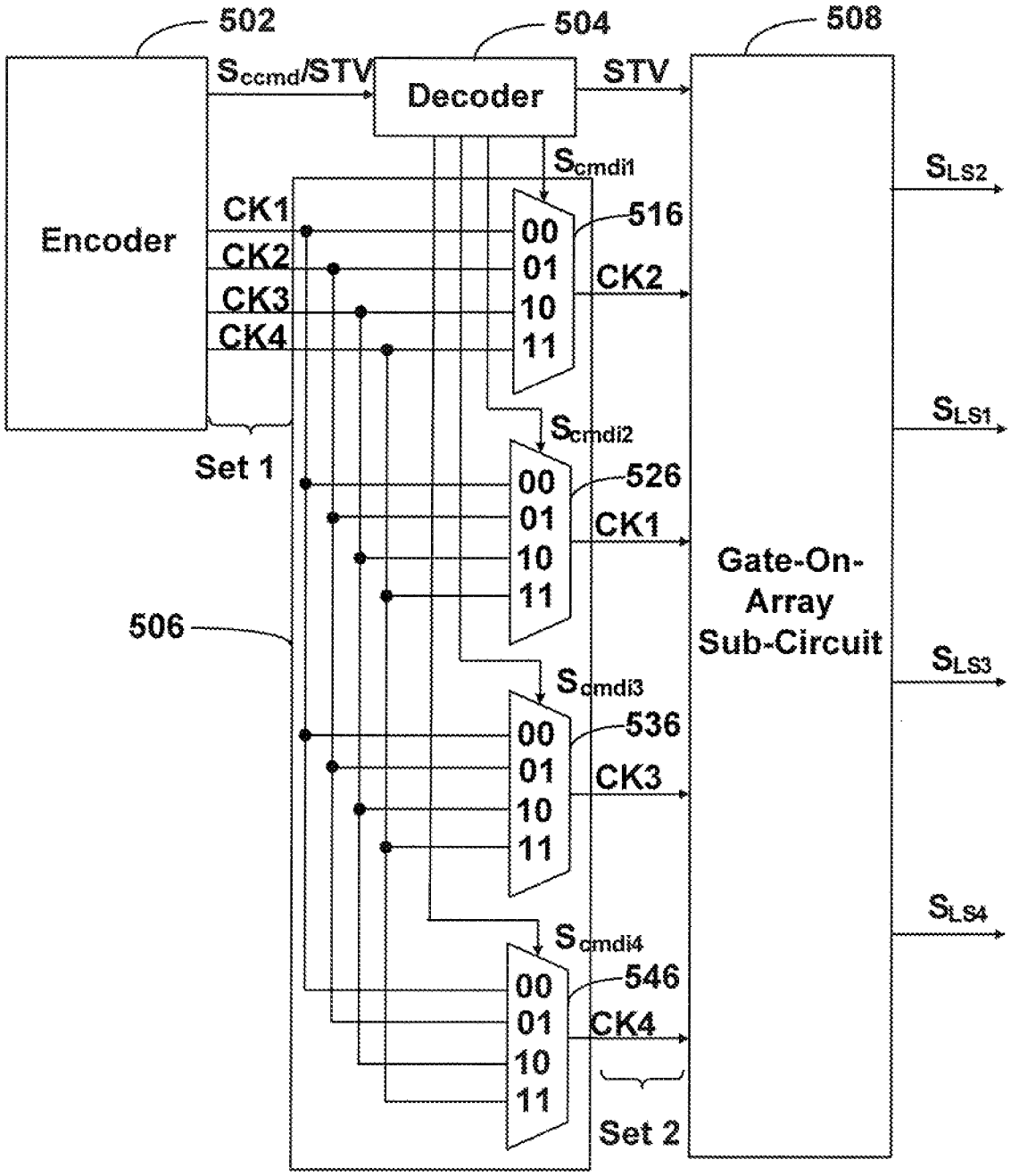
FIG. 5 is a block diagram of a gate driver control circuit according to some embodiments of the present disclosure.

FIG. 5 is a block diagram of a gate driver control circuit according to some embodiments of the present disclosure. Referring to FIG. 5, the gate driver control circuit includes an encoder 502, a decoder 504, at least one multiplexer (one is shown in FIG. 5) 506, and at least one gate-on-array sub-circuit (one is shown in FIG. 5) 508. In an embodiment, the multiplexer 506 is the multiplexer 106 of FIG. 1.

In some embodiments, the multiplexer 506 is configured to receive a first set of multiple timing-control signals from the encoder 502. For example, the first set of multiple timing-control signals includes four timing-control signals CK1~CK4 without any timing order adjustment yet. In other words, the encoder 502 is configured to send the first set of multiple timing-control signals with non-adjusted timing order.

In some embodiments, the coded instruction generated by the encoder 502 includes multiple sub-instructions information. For example, instruction information $S_{cmdi}$ can include four sub-instructions $S_{cmdi1}$~$S_{cmdi4}$, or optionally other numbers of sub-instructions. In the embodiment, the decoder 504 can perform a decoding operation to decode the coded instruction $S_{ccmd}$ to obtain the instruction information and divide the instruction information into those multiple sub-instructions, which are sent to the multiplexer 506.

In some embodiments, the multiplexer 506 includes multiple AND-gate sub-circuits, e.g., 516, 526, 536, and 546. Each AND-gate sub-circuit is configured to receive the first set of the multiple timing-control signals and one respective sub-instruction information. After some logic AND calculations, the multiplexer 506 outputs one respective timing-control signal in the second set of multiple timing-control signals with an adjusted timing order. For example, decoder 504 sends sub-instruction information $S_{cmdi1}$ to the AND-gate sub-circuit 516. The AND-gate sub-circuit 516 not only receives the sub-instruction information $S_{cmdi1}$, but also receives four timing-control signals CK1~CK4 with non-adjusted timing order (i.e., the first set of 4 timing-control signals) respectively through four terminals (00, 01, 10, and 11). The AND-gate sub-circuit 516 performs logic AND calculations on the first set of multiple timing-control signals and the sub-instruction information $S_{cmdi1}$ to output one timing-control signal CK2. Similarly, other AND-gate sub-circuits also respectively output corresponding timing-control signals. For example, AND-gate sub-circuit 526 outputs CK1, AND-gate sub-circuit 536 outputs CK3, and AND-gate sub-circuit outputs CK4. The multiplexer performs the adjustment to the original timing order of the first set of multiple timing-control signals CK1~CK4 and outputs the second set of the multiple timing-control signals CK1~CK4 in the adjusted timing order (i.e., CK2→CK1→CK3→CK4) to the gate-on-array sub-circuit 508. The gate-on-array sub-circuit 508 then outputs respective row-scanning signals in a corresponding order.

Figure 6:
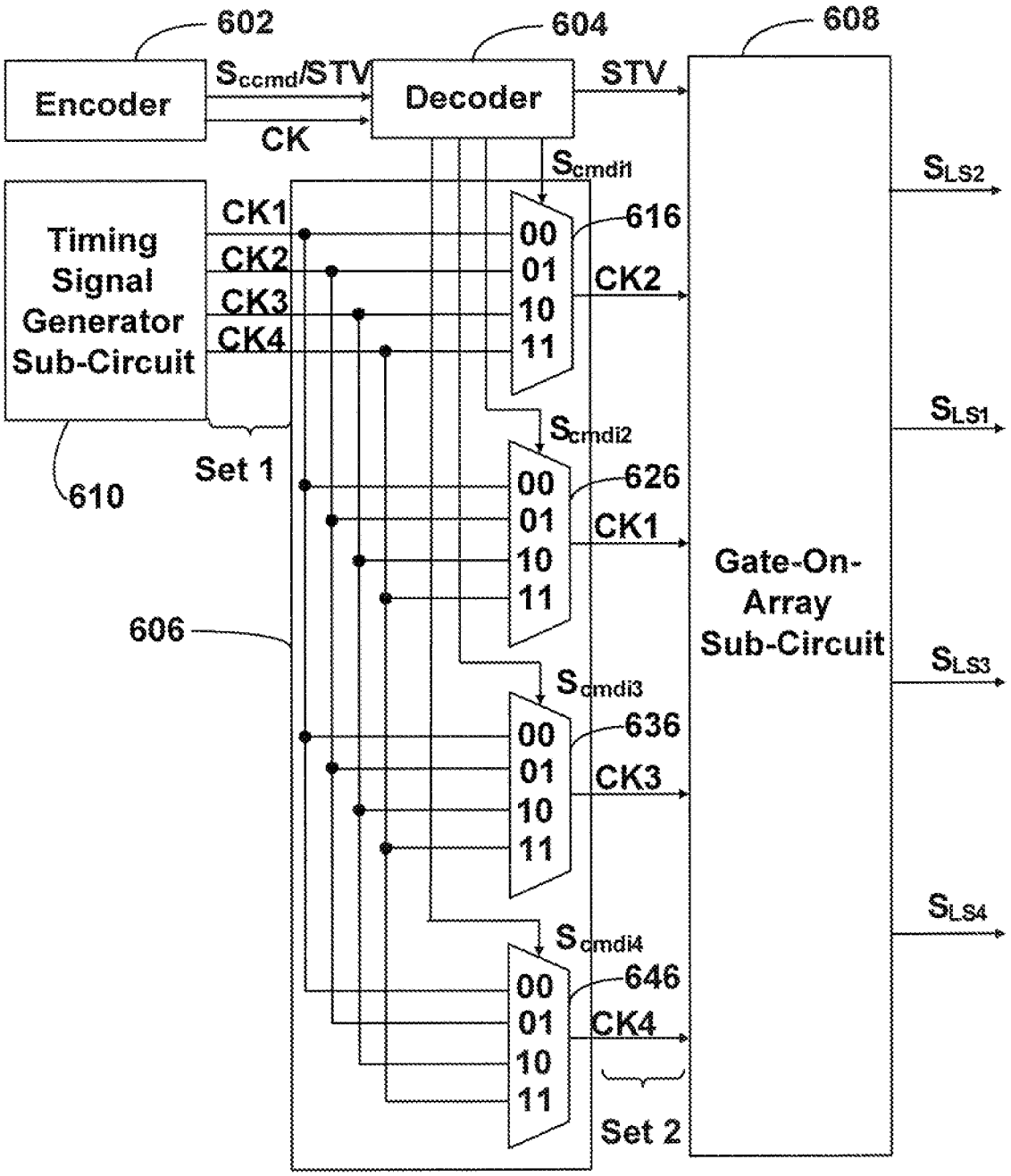
FIG. 6 is a block diagram of another gate driver control circuit according to some embodiments of the present disclosure.

FIG. 6 is a block diagram of another gate driver control circuit according to some embodiments of the present disclosure. Referring to FIG. 6, the gate driver control circuit includes a decoder 604, a multiplexer 606 including four AND-gate sub-circuits 616, 626, 636, and 646), and a gate-on-array sub-circuit 608. In an embodiment, these devices or sub-circuits are similar to what have been shown in FIG. 5, decoder 504, multiplexer 506 including four AND-gate sub-circuits 516, 526, 536, and 546, and gate-on-array sub-circuit 508. Unlike FIG. 5, in the gate driver control circuit of FIG. 6, the encoder 602 is configured to output timing-control signal CK to the decoder 604.

In some embodiments, the gate driver control circuit also includes a timing signal generator sub-circuit 610 configured to generate a first set of multiple timing-control signals and send the first set of multiple timing-control signals to the multiplexer 606. For example, the first set of multiple timing-control signals includes four timing-control signals CK1~CK4 with non-adjusted timing order. By individually setting the timing signal generator sub-circuit 610 to generate and output the first set of multiple timing-control signals with an original timing order to the multiplexer 606 and the mutliplexer performs an adjustment to the original timing order and outputs the second set of multiple timing-control signals with the adjusted timing order to the gate-on-array sub-circuit 508.

In another aspect, the present disclosure provides a display apparatus including the gate driver control circuit described herein as shown in FIG. 1, FIG. 2A, FIG. 3A, FIG. 4A, FIG. 5, or FIG. 6. The display apparatus can be a display panel or a hardware product containing a display panel, for example, a display screen, a displayer, a smart phone, a tablet computer or others.

Figure 7:
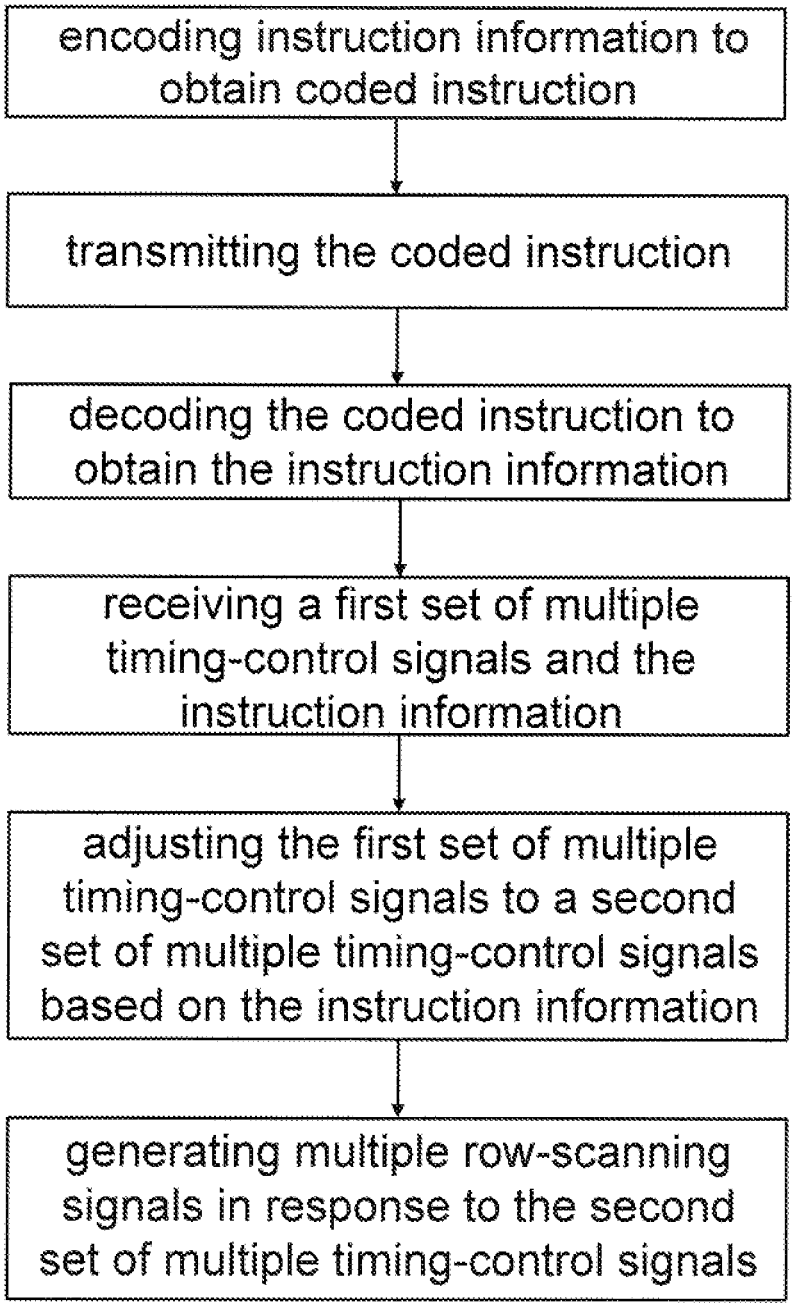
FIG. 7 is a flow chart showing a method of driving a gate driver control circuit according to some embodiments of the present disclosure.

In yet another aspect, the present disclosure provides a method of driving the gate driver control circuit for flexibly controlling the way of driving a display panel to display image for achieving power consumption. FIG. 7 is a flow chart showing a method of driving a gate driver control circuit according to some embodiments of the present disclosure. Referring to FIG. 7, the method includes encoding instruction information to obtain coded instruction and transmitting the coded instruction. The method further includes decoding the coded instruction to obtain the instruction information. Additionally, the method includes receiving a first set of multiple timing-control signals and the instruction information. Furthermore, the method includes adjusting the first set of multiple timing-control signals to a second set of multiple timing-control signals based on the instruction information. Moreover, the method includes generating multiple row-scanning signals in response to the second set of multiple timing-control signals.

In some embodiments, the step of encoding instruction information to obtain coded instruction and transmitting the coded instruction includes using an encoder to encode the instruction information to the coded instruction and using the same encoder to transmit the coded instruction to a decoder. The step of decoding the coded instruction to obtain the instruction information includes using the decoder to decode the coded instruction to obtain the instruction information. The step of receiving a first set of multiple timing-control signals and the instruction information is performed using a multiplexer to receive the first set of multiple timing-control signals and the instruction information. Optionally, the first set of multiple timing-control signals is received from a timing signal generator sub-circuit or directly from the encoder. Optionally, the instruction information is received from the decoder. The step of adjusting the first set of multiple timing-control signals to a second set of multiple timing-control signals based on the instruction information includes performing timing order adjustment in the multiplexer based on the instruction information to change a first (original) timing order associated with the first set of multiple timing-control signals to a second (adjusted) timing order to form a second set of multiple timing-control signals. Optionally, the adjustment of timing order is performed by performing one or more logic AND calculations. The second set of multiple timing-control signals with the adjusted timing order is sent to a gate-on-array sub-circuit or other gate driving sub-circuit associated with a display panel. The step of generating multiple row-scanning signals in response to the second set of multiple timing-control signals includes operating the gate-on-array sub-circuit to generate multiple row-scanning signals in a timing order corresponding to the adjusted timing order to drive the display panel to display image, thereby achieving desired power consumption reduction.

In some embodiments, the method includes setting the instruction information based on data information of images to be displayed. The instruction information includes a timing order of the first set of multiple timing-control signals. Optionally, the encoder sends clock setting signals via a first control line to the decoder. Optionally, the encoder sends a gate-driver start-up voltage signal and the coded instruction via a second control line to the decoder. The timing order of the clock setting signal corresponds to the timing order of the coded instruction. In some other embodiments, the encoder sends coded instruction via a first control line to the decoder and sends gate-driver start-up voltage signals via a second control line to the decoder. In some other embodiments, the encoder sends the gate-driver start-up voltage signal and coded instruction via a control line to the decoder.

Figure 8:
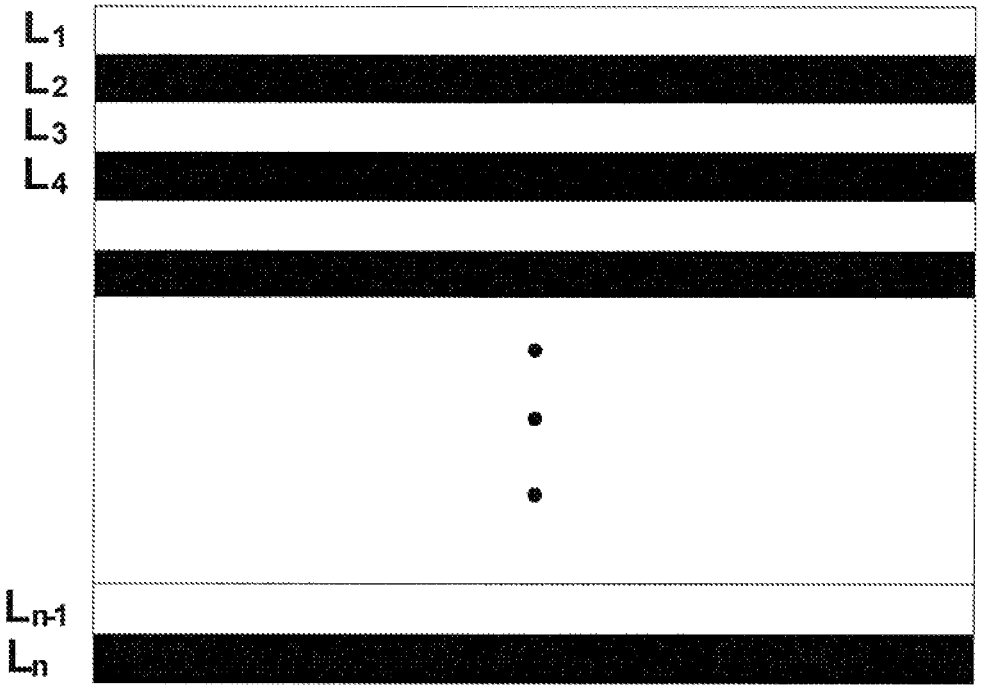
FIG. 8 is a schematic diagram showing an exemplary image with alternate black and white strips on a display panel according to some embodiments of the present disclosure.

FIG. 8 is a schematic diagram showing an exemplary image with alternate black and white strips on a display panel according to some embodiments of the present disclosure. Referring to FIG. 8, the displayed image is a so-called H-stripe shaped image. White color (with data FF) stripes and black color (with data 00) stripes are alternately shown on the display panel. For example, the first row $L_1$ is shown in white color. The second row $L_2$ is shown in black color. Since a transition from black color to white color or from white color to black color needs a maximum voltage difference to the driving circuit, leading to a maximum voltage swing during charging/discharging process for each row of the display panel and huge power consumption. By changing the timing order of control signals, the order of black-white color stripes may be adjusted accordingly to reduce numbers of charging/discharging process or reduce numbers of voltage swing so that the power consumption of the display panel can be reduced.

Figure 9:
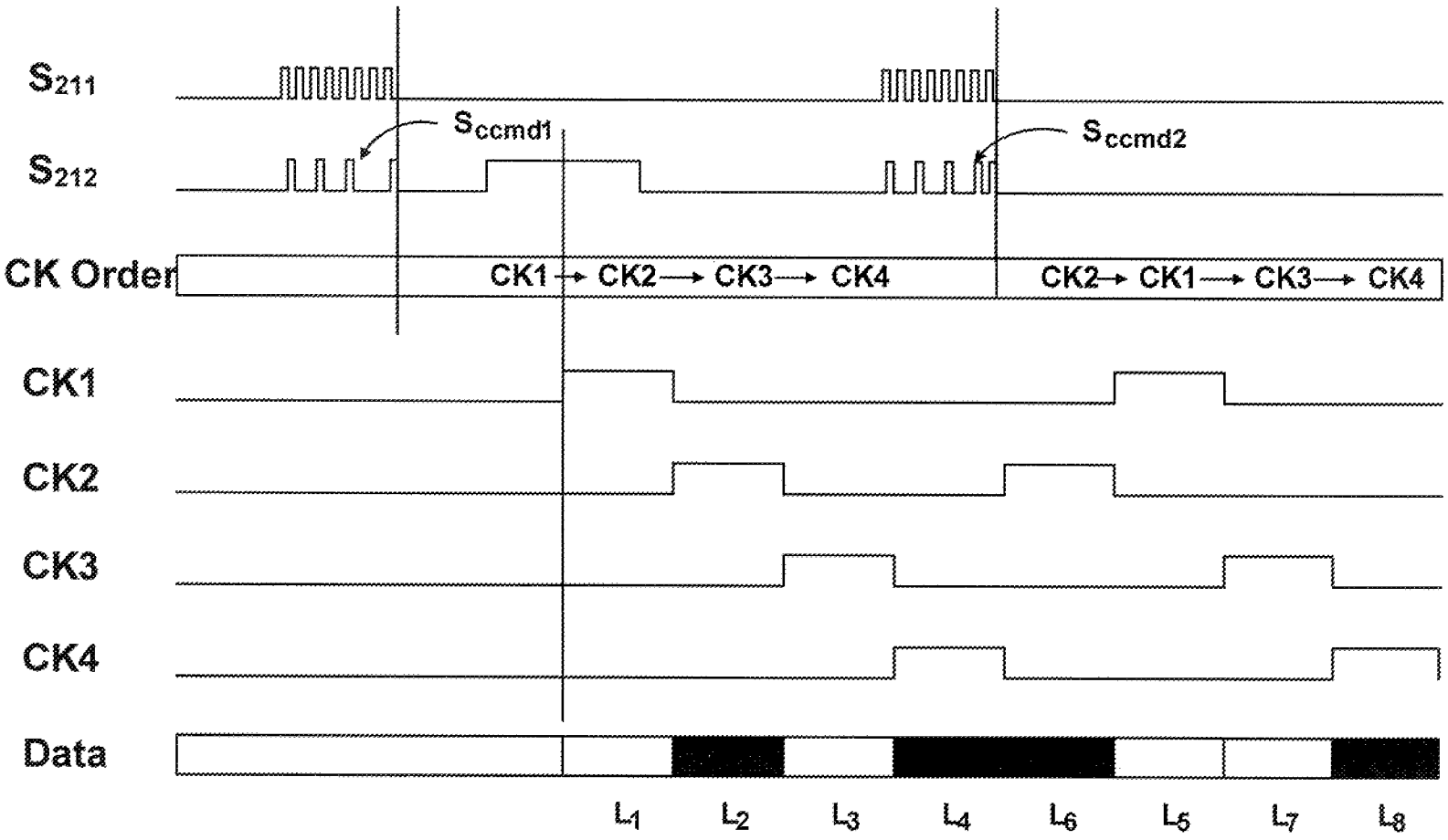
FIG. 9 is a schematic diagram showing timing-control signals for driving the display apparatus for displaying the exemplary image with alternate black and white strips according to some embodiments of the present disclosure.

FIG. 9 is a schematic diagram showing timing-control signals for driving the display apparatus for displaying the exemplary image with alternate black and white strips according to some embodiments of the present disclosure. Referring to FIG. 9, the timing-control signals are based on the gate driver control circuit of FIG. 2A. As a first coded instruction $S_{ccmd1}$ appears, the timing order of the timing-control signals is CK1→CK2→CK3→CK4. This timing order corresponds to a displayed image on the display panel with four stripes of "white black white black" from the first row $L_1$ to the fourth row $L_4$. When a second coded instruction $S_{ccmd2}$ appears, the timing order of the timing-control signal CK is changed to CK2→CK1→CK3→CK4. Although the corresponding displayed image from the fifth row $L_5$ to the eighth row $L_8$ remains a pattern of "white black white black", the scanning order has been changed to $L_6 \rightarrow L_5 \rightarrow L_7 \rightarrow L_8$. The displayed image from the first row L1 to the eighth row L8 is shown as "white black white black white black white black", but the scanning order has been changed to $L_1 \rightarrow L_2 \rightarrow L_3 \rightarrow L_4 \rightarrow L_6 \rightarrow L_5 \rightarrow L_7 \rightarrow L_8$. As the stripes in both the fourth row $L_4$ and the sixth row $L_6$ are black color, no transition of charging/discharging process is needed from the fourth row 1 to the sixth row $L_6$. Additionally, as the stripes in both the fifth row $L_5$ and the seventh row $L_7$ are white color, no transition of charging/discharging process is needed from the fifth row $L_5$ to the seventh row $L_7$. Therefore, power consumption of the display panel can be reduced.

The above example is merely using an simple extreme case of reducing number of transition of displaying image data FF to 00 or 00 to FF to illustrate the method disclosed by the present invention. In general, the gate driver control circuit can be configured to dynamically adjust displaying rows on the display panel. For displaying a same frame of image, the scanning order of each individual row can be adjusted with different order based on the specific image data so that the overall power consumption for the display panel can be optimized.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A gate driver control circuit comprising:

an encoder configured to encode instruction information to obtain a coded instruction and to transmit the coded instruction;

a decoder coupled to the encoder and configured to decode the coded instruction to obtain the instruction information;

at least one multiplexer coupled to the decoder, each multiplexer being configured to receive a first set of multiple timing-control signals and the instruction information and being configured to adjust the first set of multiple timing-control signals to a second set of multiple timing-control signals based on the instruction information and to output the second set of multiple timing-control signals; and at least one gate-array sub-circuit, each gate-array sub-circuit being configured to output multiple row-scanning signals in response to the second set of multiple timing-control signals.

2. The gate driver control circuit of claim 1, wherein each multiplexer is configured to adjust a first timing order of the first set of multiple timing-control signals to a second timing order based on the instruction information to obtain the second set of multiple timing-control signals, the second set of multiple timing-control signals being the first set of multiple timing-control signals in the second timing order.

3. The gate driver control circuit of claim 2, wherein each gate-array sub-circuit is configured, in response to the second set of multiple timing-control signals, to output the multiple row-scanning signals in a timing order corresponding to the second timing order.

4. The gate driver control circuit of claim 2, wherein the encoder is configured to determine instruction information based on data information for an image to be displayed, wherein the instruction information comprises the second timing order.

5. The gate driver control circuit of claim 1, wherein the encoder is configured to transmit a clock-setting signal through a first control line to the decoder and to transmit a gate-driver start signal and the coded instruction through a second control line to the decoder; and timing order of the clock-setting signal is associated with timing order of the coded instruction.

6. The gate driver control circuit of claim 1, wherein the encoder is configured to transmit the coded instruction through a first control line to the decoder and to transmit a gate-driver start signal through a second control line to the decoder.

7. The gate driver control circuit of claim 1, wherein the encoder is configured to transmit a gate-driver start signal and the coded instruction through a control line to the decoder.

8. The gate driver control circuit of claim 5, wherein the decoder is configured to transfer the gate-driver start signal to the gate-array sub-circuit; and the gate-array sub-circuit is further configured to output the row-scanning signals in response to the gate-driver start signal.

9. The gate driver control circuit of claim 1, wherein the instruction information comprises multiple sub-instructions information associated respectively with the first set of multiple timing-control signals; and the multiplexer comprises multiple AND-gate sub-circuits, each of the multiple AND-gate sub-circuits being configured to receive the first set of multiple timing-control signals and the multiple sub-instructions information, and to output one of the second set of multiple timing-control signals based on logic AND calculations of the first set of multiple timing-control signals and the multiple sub-instructions information.

10. The gate driver control circuit of claim 1, wherein each multiplexer is configured to receive the first set of multiple timing-control signals from the encoder.

11. The gate driver control circuit of claim 1, further comprising a timing-signal generator sub-circuit configured to generate the first set of multiple timing-control signals and to transmit the first set of multiple timing-control signals to the at least one multiplexer.

12. A display apparatus comprising a gate driver control circuit of claim 1.

13. A method for driving a gate driver control circuit comprising:

encoding instruction information to obtain coded instruction;

transmitting the coded instruction;

decoding the coded instruction to obtain the instruction information;

receiving a first set of multiple timing-control signals and the instruction information;

adjusting the first set of multiple timing-control signals to a second set of multiple timing-control signals based on the instruction information; and generating multiple row-scanning signals in response to the second set of multiple timing-control signals.

14. The method of claim 13, wherein encoding instruction information comprises using an encoder to encode the instruction information to the coded instruction.

15. The method of claim 14, wherein transmitting the coded instruction and decoding the coded instruction comprise using the encoder to transmit the coded instruction to a decoder and using the decoder to decode the coded instruction to obtain the instruction information.

16. The method of claim 15, wherein adjusting comprises using a multiplexer to adjust a first timing order of the first set of multiple timing-control signals to a second timing order based on the instruction information to obtain the second set of multiple timing-control signals, the second set of multiple timing-control signals being the first set of multiple timing-control signal in the second timing order.

17. The method of claim 16, wherein generating multiple row-scanning signals in response to the second set of multiple timing-control signals comprises using a gate-array sub-circuit to output the multiple row-scanning signals in a timing order corresponding to the second timing order.

18. The method of claim 17, wherein encoding instruction information comprises determining the instruction information based on data information for an image to be displayed, wherein the instruction information includes the second timing order.

19. The method of claim 15, wherein transmitting the coded instruction and decoding the coded instruction comprise further comprise transmitting a clock-setting signal through a first control line to the decoder and transmitting a gate-driver start signal and the coded instruction through a second control line to the decoder; or transmitting the coded instruction through a first control line to the decoder and transmitting a gate-driver start signal through a second control line to the decoder.

20. The method of claim 15, wherein transmitting the coded instruction and decoding the coded instruction further comprise transmitting the gate-driver start signal and the coded instruction through a control line to the decoder.

* * * * *